US007678746B2

(12) United States Patent
Roski et al.

(10) Patent No.: US 7,678,746 B2
(45) Date of Patent: Mar. 16, 2010

(54) LUBRICATING COMPOSITIONS CONTAINING SULPHONATES AND PHENATES

(75) Inventors: James P. Roski, Wickliffe, OH (US); Richard Leahy, Hessle (GB); Stephen J. Cook, Belper (GB); Alexandra Mayhew, Burton on Trent (GB)

(73) Assignee: The Lubrizol Corporation, Wickliffe, OH (US)

( * ) Notice: Subject to any disclaimer, the term of this patent is extended or adjusted under 35 U.S.C. 154(b) by 854 days.

(21) Appl. No.: 11/128,855

(22) Filed: May 13, 2005

(65) Prior Publication Data

US 2005/0209110 A1 Sep. 22, 2005

Related U.S. Application Data

(63) Continuation-in-part of application No. PCT/US2004/036312, filed on Oct. 29, 2004.

(60) Provisional application No. 60/515,915, filed on Oct. 30, 2003, provisional application No. 60/571,393, filed on May 14, 2004.

(51) Int. Cl.
*C10M 159/22* (2006.01)
*C10M 159/24* (2006.01)

(52) U.S. Cl. ..... 508/192; 508/391; 508/443; 508/486; 508/574

(58) Field of Classification Search ..... 508/192, 508/391, 398, 572, 574, 443, 486
See application file for complete search history.

(56) References Cited

U.S. PATENT DOCUMENTS

| | | | | |
|---|---|---|---|---|
| 3,793,201 A | | 2/1974 | Karn | |
| 4,664,822 A | * | 5/1987 | Hunt et al. | 508/192 |
| 4,952,328 A | | 8/1990 | Davis et al. | 252/32.7 E |
| 5,037,565 A | * | 8/1991 | King | 508/398 |
| 5,071,576 A | * | 12/1991 | Vernet et al. | 508/398 |
| 5,792,732 A | | 8/1998 | Jao et al. | |
| 6,107,259 A | | 8/2000 | Muir et al. | |
| 6,277,794 B1 | * | 8/2001 | Dunn | 508/199 |
| 6,339,051 B1 | | 1/2002 | Carey et al. | |
| 6,376,434 B1 | | 4/2002 | Katafuchi | |
| 6,444,625 B1 | | 9/2002 | Muir et al. | |
| 6,551,965 B2 | | 4/2003 | Nagamatsu et al. | |

FOREIGN PATENT DOCUMENTS

| | | |
|---|---|---|
| DE | 298 519 A5 | 2/1992 |
| EP | 0 765 931 | 4/1997 |
| EP | 0 808 830 | 11/1997 |
| EP | 1086960 | 3/2001 |
| EP | 1126010 | 8/2001 |
| GB | 2328217 A | 2/1999 |

OTHER PUBLICATIONS

JPO Machine Translation of JP 09-227 503, Sep. 2, 1997.
Abstract of JP 09-227 503, Sep. 2, 1997, Patent Abstracts of Japan © 1997, JPO.

* cited by examiner

*Primary Examiner*—Glenn A Caldarola
*Assistant Examiner*—Taiwo Oladapo
(74) *Attorney, Agent, or Firm*—David M. Shold; Christopher D. Hilker

(57) ABSTRACT

A lubricating composition containing (a). at least 3 weight percent of an overbased sulphonate detergent with a metal ratio of 12.5:1 to 40:1; (b). at least 1.5 weight percent of a sulphur containing phenate detergent with a metal ratio of not more than 2.5; and (c). an oil of lubricating viscosity, wherein the sulphur containing phenate contains oligomers of hydrocarbyl phenol with at least 50 wt % of said oligomers in the form of the tetramer or higher oligomers. The composition is suitable for internal combustion engines, particularly marine diesel applications to provide improved cleanliness decreased cylinder wear and reduced deposits.

20 Claims, No Drawings

LUBRICATING COMPOSITIONS CONTAINING SULPHONATES AND PHENATES

CROSS-REFERENCE TO RELATED APPLICATIONS

This application claims priority as a continuation-in-part of PCT application PCT/US 2004/036312, international filing date 29 Oct. 2004, which in turn claims priority from U.S. provisional application 60/515,915, filed 30 Oct. 2003. This application also claims priority from U.S. Provisional Application 60/571,393, filed 15 May, 2004.

FIELD OF INVENTION

The present invention relates to novel detergent compositions containing (a) at least 3 weight percent of an overbased sulphonate detergent with a metal ratio of 12.5:1 to 40:1; (b) at least 1.5 weight percent of a sulphur containing phenate detergent with a metal ratio of not more than 3; and (c) an oil of lubricating viscosity, wherein the sulphur containing phenate contains oligomers of hydrocarbyl phenol with at least 50 wt % of said oligomers in the form of the tetramer or higher oligomers. The invention further relates to the use of the novel detergent compositions in marine diesel cylinder lubricants.

BACKGROUND OF THE INVENTION

It is known to add various additives to an oil of lubricating viscosity for diesel or gasoline engines to reduce wear and improve cleanliness. In diesel engines an oil of lubricating viscosity is used particularly to reduce wear of cylinder liners and piston rings. Often engine operating temperatures and pressures are sufficient to break down the film of the oil of lubricating viscosity on the internal walls of the cylinder. As a consequence of this, the cylinder experiences increased wear and decreased engine cleanliness due to deposits. Formation of high levels of deposits around the piston rings can also result in excessive wear.

U.S. Pat. No. 6,277,794, Dunn, discloses the use of a marine diesel engine lubricant composition containing (a) an overbased metal detergent having a TBN of at least 300 and/or (b) a metal detergent other than component (a), provided that if detergent (b) is present the composition does not contain a minor amount of an extreme pressure additive; and (c) ashless antiwear additives; and (d) an oil of lubricating viscosity.

U.S. Pat. No. 6,339,051, Carey et al., discloses diesel cylinder oils with improved cleanliness and load carrying capabilities by using an additive package containing at least one detergent, an antioxidant, an antiwear agent and a dispersant. The detergent component contains at least one of an overbased phenate, phenylate, salicylate or sulphonate.

U.S. Pat. No. 6,376,434, Katafuchi, discloses lubricating oil compositions for diesel engines containing at least one of (a) overbased sulphonate, overbased phenates and overbased salicylates; and (b) a bis-type succinic imide compound.

U.S. Pat. No. 6,551,965, Nagamatsu, discloses a marine diesel lubricating oil composition containing an overbased alkyl sulphonate detergent and an overbased sulphurised alkylphenate detergent. The overbased sulphurised alkylphenate has a TBN of 110 or more.

British Patent application GB 2,328,217 A discloses marine diesel lubricating oil compositions containing a polyalkylene succinimide compound for improving anti-wear. The lubricating oil composition can further include up to 6% of at least one highly overbased detergent selected from alkyl or alkenyl phenates, alkyl or alkenyl phenate-carboxylates, alkyl or alkenyl aromatic sulphonates; and mixtures thereof.

European Patent application EP 1,126,010 Nagamatsu et al., discloses a lubricating oil composition containing an overbased alkylsulphonate detergent and an overbased sulphurised phenate. The sulphurised phenate and overbased alkylsulphonate are present at on a weight ratio basis of 55:45 to 95:5. The composition further includes a zinc antiwear agent such as dialkyldithiophosphate and a dispersant.

European Patent application EP 1,086,960 discloses a lubricating oil composition containing novel succinimide compounds and at least one detergent selected from overbased sulphonates, phenates and salicylates of alkaline earth metals.

East German Patent DD298519 discloses marine diesel engines employing an anticorrosion detergent-dispersant additive combination containing (a) weakly basic or neutral alkaline earth sulphonates; and (b) medium or highly basic alkaline earth sulphonates, phenolates or phenolate sulphides in which the ratio of sulphonate groups to phenolic groups is 1:3.6 to 4.4; and (c) a succinimide ash free detergent.

It would be desirable to have compositions with cleanliness properties. The invention provides compositions with cleanliness properties.

It would be desirable to have compositions capable of reducing wear and reducing deposits. The invention provides compositions capable of reducing wear and reducing deposits.

SUMMARY OF THE INVENTION

The present invention provides a composition comprising:

(a) at least 3 weight percent of an overbased sulphonate detergent with a metal ratio of 12.5:1 to 40:1;

(b) at least 1.5 weight percent of a sulphur containing phenate detergent with a metal ratio of not more than 3; and (c) an oil of lubricating viscosity, wherein the sulphur containing phenate contains oligomers of hydrocarbyl phenol with at least 50 wt % of said oligomers in the form of the tetramer or higher oligomers.

The invention further provides a composition comprising:

(a). at least 3 weight percent of an overbased sulphonate detergent with a metal ratio of 12.5:1 to 40:1;

(b). at least 1.5 weight percent of a sulphur containing phenate detergent with a metal ratio of not more than 3;

(c). an oil of lubricating viscosity, and (d). an antiwear agent, which can be, if desired, selected from the group consisting of salixarates, fatty amines, amine salts, phosphoric acid esters, thiocarbamate esters, thiocarbamates amides, thiocarbamic ethers, alkylene-coupled thiocarbamates, bis(S-alkyldithocarbamyl)disulfides, monoesters of polyols and aliphatic carboxylic acids, and borate esters;

wherein the sulphur containing phenate contains oligomers of hydrocarbyl phenol with at least 50 wt % of said oligomers in the form of the tetramer or higher oligomers.

The invention further provides a process to prepare a composition comprising mixing:

(a) at least 3 weight percent of an overbased sulphonate detergent with a metal ratio of 12.5:1 to 40:1;

(b) at least 1.5 weight percent of a sulphur containing phenate detergent with a metal ratio of not more than 3; and (c) an oil of lubricating viscosity, wherein the sulphur containing phenate contains oligomers of hydrocarbyl phenol with at least 50 wt % of said oligomers in the form of the tetramer or higher oligomers.

The invention further provides a method for lubricating an internal combustion engine, comprising supplying thereto a lubricant comprising the composition as described herein.

The invention further provides a composition with cleanliness properties. The invention further provides a composition capable of reducing wear and capable of reducing deposits.

DETAILED DESCRIPTION OF THE INVENTION

The present invention provides, in certain embodiments, a composition comprising:

(a) at least 3 weight percent of an overbased sulphonate detergent with a metal ratio of 12.5:1 to 40:1;

(b) at least 1.5 weight percent of a sulphur containing phenate detergent with a metal ratio of not more than 3; and (c) an oil of lubricating viscosity, wherein the sulphur containing phenate contains oligomers of hydrocarbyl phenol with at least 50 wt % of said oligomers in the form of the tetramer or higher oligomers.

The total amount of (a) and (b) present on an oil free basis is often from 4.5 wt % to 35 wt %, in one aspect 6.5 wt % to 32 wt %, in another aspect 9 wt % to 30 wt % and in yet another aspect 12 wt % to 28 wt % of the composition. In one embodiment the weight percent of component (a) is 94.7 wt % and component (b) is 5.3 wt % of the total amount of (a) and (b) present. In one embodiment the amount of component (a) is 75 wt % and component (b) is 25 wt % of the total amount of (a) and (b) present.

Often the total base number (TBN) of the composition is 30 or higher, in one aspect 40 or higher, in another aspect 50 or higher and in yet another aspect 60 or higher. In one embodiment, the specific amounts of component (a) and component (b) are present such that component (a) delivers at least 50%, in another embodiment at least 55%, in another embodiment at least 60, in another embodiment at least 65 and in yet another embodiment at least 70% of the TBN supplied by the detergents (a) and (b).

In one embodiment the weight percent ratio of overbased sulphonate to sulphur containing phenate detergent is often 30:1 to 0.85:1, in one aspect 25:1 to 0.9:1, in another aspect 20:1 to 0.95:1, in yet another aspect 20:1 to 1:1 and in yet another aspect 20:1 to 1.02:1. In embodiment the weight percent ratio of overbased sulphonate to sulphur containing phenate detergent is 15:1 to 1.05:1, in another embodiment 10:1 to 1.05:1 and in another embodiment 10:1 to 1.1:1.

Overbased Sulphonate Detergent

The sulphonate detergent of the composition may be represented by the formula:

$$(R^1)_k\text{-A-SO}_3\text{M} \quad \text{(I)}$$

wherein each $R^1$ is independently an alkyl, cycloalkyl, aryl, acyl, or other hydrocarbyl group with 6 to 40, in one aspect 8 to 25 and in another aspect 9 to 20 carbon atoms; A may be independently a cyclic or acyclic hydrocarbon group; M is hydrogen, a valence of a metal ion, an ammonium ion or mixtures thereof; and k is an integer of 0 to 5, for example 0, 1, 2, 3, 4, 5. In one aspect k is 1, 2 or 3, in another aspect 1 or 2 and in yet another aspect 1. Often hydrogen comprises less than 30%, in one aspect less than 20%, in another aspect less than 10% and in yet another aspect less than 5% of the available M entities.

In one embodiment k is 1 and $R^1$ is a branched alkyl group with 6 to 40 carbon atoms. In one embodiment k is 1 and $R^1$ is a linear alkyl group with 6 to 40 carbon atoms.

Examples of suitable sulphonic acids capable of forming the overbased sulphonate detergent include polypropene benzene sulphonic acid, undecyl benzene sulphonic acid, dodecyl benzene sulphonic acid, tridecyl benzene sulphonic acid, tetradecyl benzene sulphonic acid, pentadecyl benzene sulphonic acid, hexadecyl benzene sulphonic acid and mixtures thereof. In one embodiment the sulphonic acid includes undecyl benzene sulphonic acid, dodecyl benzene sulphonic acid, tridecyl benzene sulphonic acid, tetradecyl benzene sulphonic acid, octadecyl benzene sulphonic acid, tetraeicosyl benzene sulphonic acid or mixtures thereof. In one embodiment of the invention the sulphonic acid is a polypropene benzene sulphonic acid, where the polypropene is often derived from 18 to 30 carbon atoms.

In one embodiment of the invention the sulphonate components are calcium polypropene benzenesulphonate and calcium monoalkyl and dialkyl benzenesulphonates wherein the alkyl groups contain at least 10 carbons, for example 11, 12, 13, 14, or 15 carbon atoms.

When M is a valence of a metal ion, the metal may be monovalent, divalent, trivalent or mixtures of such metals. When monovalent, the metal M may be an alkali metal, in one aspect lithium, sodium, or potassium; and in another aspect potassium, which may be used alone or in combination with other metals. When divalent, the metal M may be an alkaline earth metal, in one aspect magnesium, calcium, barium or mixtures of such metals, in another aspect calcium, which may be used alone or in combination with other metals. When trivalent, the metal M may be aluminium, which may be used alone or in combination with other metals. In one embodiment the metal is an alkaline earth metal. In one embodiment the metal is calcium.

When A is cyclic hydrocarbon group, suitable groups include phenyl or fused bicyclic groups such as naphthalene, indenyl, indanyl, bicyclopentadienyl and mixtures thereof. Although A may be a fused bicyclic ring, benzene rings are often especially useful.

When A is an acyclic hydrocarbon group, the carbon chain may be linear or branched, although linear is especially useful. Suitable groups include derivatives of carboxylic acids containing 7 to 30, in one aspect 7 to 20, in another aspect 8 to 20 and in yet another aspect 8 to 15 carbon atoms. Further the chain may be saturated or unsaturated, although saturated is especially useful.

Typically the overbased sulphonate detergent has a TBN (total base number) of at least 400, in one aspect at least 425, in another aspect at least 450 and in yet another aspect at least 475. In one embodiment the overbased sulphonate detergent has a TBN of 500, or of 500 to 550.

Overbasing the Sulphonate Detergent

The sulphonate detergent is overbased. Overbased materials, otherwise referred to as overbased or superbased salts, are generally single phase, homogeneous Newtonian systems characterised by a metal content in excess of that which would be necessary for neutralisation according to the stoichiometry of the metal and the particular acidic organic compound reacted with the metal. The overbased materials are prepared by reacting an acidic material (typically an inorganic acid or lower carboxylic acid, often carbon dioxide) with a mixture comprising an acidic organic compound, a reaction medium comprising at least one organic solvent and promoter such as phenol or a mixture of alcohols. A mixture of alcohols typically contains methanol and at least one alcohol with 2 to 7 carbon atoms, and may contain 50-60 mole percent methanol. The acidic material will normally have a sufficient number of carbon atoms to provide a degree of solubility in oil. The amount of excess metal is commonly expressed in terms of substrate to metal ratio. The term "substrate to metal ratio" is the ratio of the total equivalents of the metal to the equivalents of the substrate. An overbased sulphonate detergent typically has a metal ratio of 12.5:1 to 40:1, in one aspect 13.5:1 to 40:1, in another aspect 14.5:1 to 40:1, in yet another aspect 15.5:1 to 40:1 and in yet another aspect 16.5:1 to 40:1. Furthermore the overbased detergent often has a low in-process viscosity and a low final viscosity.

A sulphonate detergent with 500 TBN and its preparation are disclosed in U.S. Pat. No. 5,792,732. In Example 2 thereof, a 500 TBN all-linear alkylbenzene sulphonate is prepared by reacting an alkyl benzene sulphonate from Witco Corp. (now known as Crompton) with $Ca(OH)_2$ and CaO in n-heptane and methanol and bubbling with $CO_2$. It is also reported in the aforementioned patent (col. 5) that a 500 TBN overbased sulphonate containing highly branched alkylbenzene sulphonate is available from Witco Corp. (now known as Crompton) as Petronate® C-500. Another method for preparing an overbased sulfonate detergent of high metal ratio is disclosed in U.S. Pat. No. 6,444,625 (see, for instance, column 3, bottom). The latter process includes providing a sulfonic acid to a reactor, adding a lime reactant for neutralization and overbasing, adding a lower aliphatic $C_1$ to $C_4$ alcohol and a hydrocarbon solvent, and carbonating the process mixture with carbon dioxide during which process the exotherm of the reaction is maintained between 27° C. and 57° C. Alternatively, a high metal-ratio detergent may be prepared by using a mixture of short chain alcohols, with or without a hydrocarbon solvent, conducting the addition of lime reactants and carbon dioxide in multiple iterations, and, if desired the process of adding lime and carbon dioxide and of removal of volatile materials may be repeated. The overbased sulphonate detergent in the present invention may be used alone or with other overbased sulphonates. In one embodiment the sulphonate detergent is in a mixture with other sulphonate detergents, provided the TBN is within the given ranges.

Sulphur Containing Phenate Detergent

The sulphur containing phenate detergent of the composition may be represented by the formula:

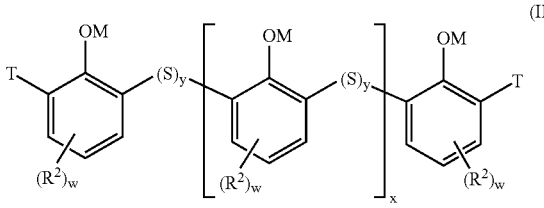

(II)

wherein the number of sulphur atoms y may be in the range from 1 to 8, in one aspect 1 to 6 and in another aspect 1 to 4; $R^2$ may be hydrogen or hydrocarbyl groups; T is hydrogen or an $(S)_y$ linkage terminating in hydrogen, an ion or a non-phenolic hydrocarbyl group; and M is as described above.

The monomeric units of structure (II) combine in such a way with itself x number of times to form oligomers of hydrocarbyl phenol. Oligomers are described as dimers, trimers, tetramers, pentamers and hexamers when x is equal to 0, 1, 2, 3, and 4, respectively. Typically the number of monomers represented by x may be 0 to 10, in one aspect 1 to 9, in another aspect 1 to 8, in yet another aspect 2 to 6 and in yet another aspect 2 to 5. Typically an oligomer is present in significant quantities if concentrations are above 0.1 wt %, in one aspect above 1 wt % and in another aspect above 2 wt %. Typically an oligomer is present in trace amounts if concentrations are less than 0.1 wt %, for example, oligomers with 11 or more repeat units may be present. Generally in at least 50% of the molecules, x is 2 or higher. In one embodiment of the invention the overall sulphur-containing phenate detergent contains less than 20 wt. % dimeric structures (x=0).

The sulphur containing phenate detergent contains oligomers of hydrocarbyl phenol with at least 50 wt % in the form of the tetramer or higher oligomers. Often the tetramer or higher oligomers are present in amounts of at least 52 wt %, in one aspect at least 54 wt %, in another aspect at least 56 wt % and in yet another aspect at least 58 wt %.

The sulphur containing phenate detergent often contains less than 20 wt %, in one aspect less than 18 wt %, in another aspect less than 16 wt % and in yet another aspect less than 14 wt % of hydrocarbyl phenol dimers.

The sulphur containing phenate detergent often contains a substrate level (that is, excluding M and any carbonate of M) in the range 45 wt % to 95 wt %, in one aspect 50 wt % to 90 wt % and in another aspect 55 wt % to 85, to 80, or to 75 wt % of the sulphur containing phenate detergent. The "substrate" means the anionic portion of Structure II or similar structures. The substrate level is calculated excluding any contribution of diluent oil to the detergent.

In Structure II, each $R^2$ may be hydrogen or a hydrocarbyl group containing 4 to 80, in one aspect 6 to 45, in another aspect 8 to 20 and in yet another aspect 9 to 14 carbon atoms. The number of $R^2$ substituents (w) other than hydrogen on each aromatic ring may be 0 to 4, in one aspect 1 to 3 and in another aspect 1 to 2. Where two or more hydrocarbyl groups are present they may be the same or different; and the minimum total number of carbon atoms present in the hydrocarbyl substituents on all the rings, to ensure oil solubility, may be 8 or in one aspect 9. Especially useful components include 4-alkylated phenols containing alkyl groups with the number of carbon atoms of 9 to 14, for example 9, 10, 11, 12, 13, 14 and mixtures thereof. The 4-alkylated phenols typically contain sulphur at position 2.

Typically the sulphur containing phenate detergent has a TBN from 30 to 220, in one aspect 40 to 205, in another aspect 50 to 190 and in yet another aspect 70 to 175. In one embodiment the sulphur containing phenate detergent has a TBN of 150. The sulphur containing phenate detergent may be used alone or with other sulphur containing phenate detergents. In one embodiment the sulphur containing phenate detergent is in a mixture with other phenate detergents, provided the TBN of the average of all the phenates is within the given ranges.

The sulphur containing phenate detergent typically has a metal ratio of not more than 3, in one aspect not more than 2.7, in another aspect not more than 2.5, in yet another aspect not more than 2.3 and in yet another aspect not more than 2.1.

The sulphur containing phenate further contains oligomers of hydrocarbyl phenol with at least 50 wt % of such oligomers being in the form of the tetramer or higher oligomers. A suitable example of calcium alkyl phenol sulphide detergent is commercially available from The Lubrizol Corporation.

Oils of Lubricating Viscosity

The invention further includes oil of lubricating viscosity. Such oils include natural and synthetic oils, oil derived from hydrocracking, hydrogenation, and hydrofinishing, unrefined, refined and re-refined oils and mixtures thereof.

Unrefined oils are those obtained directly from a natural or synthetic source generally without (or with little) further purification treatment.

Refined oils are similar to the unrefined oils except they have been further treated in one or more purification steps to improve one or more properties. Purification techniques are known in the art and include solvent extraction, secondary distillation, acid or base extraction, filtration, percolation and the like.

Re-refined oils are also known as reclaimed or reprocessed oils, and are obtained by processes similar to those used to obtain refined oils and often are additionally processed by techniques directed to removal of spent additives and oil breakdown products.

Natural oils useful in making the inventive lubricants include animal oils, vegetable oils (e.g., castor oil, lard oil), mineral lubricating oils such as liquid petroleum oils and solvent-treated or acid-treated mineral lubricating oils of the paraffinic, naphthenic or mixed paraffinic-naphthenic types and oils derived from coal or shale or mixtures thereof.

Synthetic lubricating oils are useful and include hydrocarbon oils such as polymerised and interpolymerised olefins (e.g., polybutylenes, polypropylenes, propyleneisobutylene copolymers); poly(1-hexenes), poly(1-octenes), poly(1-decenes), and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); alkylated diphenyl ethers and alkylated diphenyl sulphides and the derivatives, analogs and homologs thereof or mixtures thereof.

Other synthetic lubricating oils include but are not limited to liquid esters of phosphorus-containing acids (e.g., tricresyl phosphate, trioctyl phosphate, and the diethyl ester of decane phosphonic acid), and polymeric tetrahydrofurans. Synthetic oils may be produced by Fischer-Tropsch reactions and typically may be hydroisomerised Fischer-Tropsch hydrocarbons or waxes.

Oils of lubricating viscosity may also be defined as specified in the American Petroleum Institute (API) Base Oil Interchangeability Guidelines. The five base oil groups are as follows: Group I (sulphur content >0.03 wt %, and/or <90 wt % saturates, viscosity index 80-120); Group II (sulphur content ≦0.03 wt %, and ≧90 wt % saturates, viscosity index 80-120); Group III (sulphur content ≦0.03 wt %, and ≧90 wt % saturates, viscosity index ≧120); Group IV (all polyalphaolefins (PAOs)); and Group V (all others not included in Groups I, II, III, or IV). The oil of lubricating viscosity comprises an API Group I, Group II, Group III, Group IV, Group V oil and mixtures thereof. Often the oil of lubricating viscosity is an API Group I, Group II, Group III, Group IV oil and mixtures thereof. Alternatively the oil of lubricating viscosity is often an API Group I, Group II, Group III oil or mixtures thereof.

The oil of lubricating viscosity is often present at 55 to 99.9, in one aspect 61 to 98.9, in another aspect 65 to 96.8 and in yet another aspect 67 to 94 weight percent of the composition.

Other Performance Additives

Optionally the composition may include at least one performance additive other than components (a)-(c), selected from the group consisting of metal deactivators, detergents, dispersant, antioxidants, antiwear agents, corrosion inhibitors, antiscuffing agents, extreme pressure agents, foam inhibitors, demulsifiers, friction modifiers, viscosity modifiers, pour point depressants and mixtures thereof. Typically, fully-formulated lubricating oil will contain one or more of these performance additives. In some embodiments, certain anti-wear agents are present as component (d).

In one embodiment of the invention the composition contains at least one optional performance additive selected from the group consisting of a dispersant, an antioxidant and an antiwear agent.

The total combined amount of the other performance additives present on an oil free basis may be 0 to 10, in one aspect 0.1 to 7, in another aspect 0.2 to 5 and in yet another aspect 1 to 5 weight percent of the composition.

Dispersants

Dispersants are often known as ashless-type dispersants because, prior to mixing in a lubricating oil composition, they do not contain ash-forming metals and they do not normally contribute any ash forming metals when added to a lubricant and polymeric dispersants. Ashless type dispersants are characterised by a polar group attached to a relatively high molecular weight hydrocarbon chain. Typical ashless dispersants include N-substituted long chain alkenyl succinimides. Examples of N-substituted long chain alkenyl succinimides include polyisobutylene succinimide with number average molecular weight of the polyisobutylene substituent in the range 350 to 5000, in one aspect 500 to 3000. Succinimide dispersants and their preparation are disclosed, for instance in U.S. Pat. No. 4,234,435. Succinimide dispersants are typically the imide formed from a polyamine, typically a poly(ethyleneamine).

In one embodiment the invention further comprises at least one dispersant derived from polyisobutylene succinimide with number average molecular weight in the range 350 to 5000, in one aspect 500 to 3000. The polyisobutylene succinimide may be used alone or in combination with other dispersants.

In one embodiment the invention further comprises at least one dispersant derived from polyisobutylene, an amine and zinc oxide to form a polyisobutylene succinimide complex with zinc. The polyisobutylene succinimide complex with zinc may be used alone or in combination.

Another class of ashless dispersant is Mannich bases. Mannich dispersants are the reaction products of alkyl phenols with aldehydes (especially formaldehyde) and amines (especially polyalkylene polyamines). The alkyl group typically contains at least 30 carbon atoms.

The dispersants may also be post-treated by conventional methods by a reaction with any of a variety of agents. Among these are urea, thiourea, dimercaptothiadiazoles, carbon disulfide, aldehydes, ketones, carboxylic acids, hydrocarbon-substituted succinic anhydrides, maleic anhydride, nitriles, epoxides, boron compounds, and phosphorus compounds.

In one embodiment of the invention the dispersant is borated using a variety of agents selected from the group consisting of the various forms of boric acid (including metaboric acid, HBO2, orthoboric acid, $H_3BO_3$, and tetraboric acid, $H_2B_4O_7$), boric oxide, boron trioxide, and alkyl borates. In one embodiment the borating agent is boric acid which may be used alone or in combination with other borating agents.

The borated dispersant may be prepared by blending the boron compound and the N-substituted long chain alkenyl succinimides and heating them at a suitable temperature, typically 80° C. to 250° C., in one aspect 90° C. to 230° C. and in another aspect 100° C. to 210° C., until the desired reaction has occurred. The molar ratio of the boron compounds to the N-substituted long chain alkenyl succinimides is typically 10:1 to 1:4, in one aspect 4:1 to 1:3, and in another aspect 1:2. An inert liquid may be used in performing the reaction. The liquid may include toluene, xylene, chlorobenzene, dimethylformamide and mixtures thereof.

Often the dispersant is present on an oil free basis at 0 to 10, in one aspect 0.01 to 5, in another aspect 0.02 to 2 and in yet another aspect 0.05 or 0.1 to 1 weight percent of the composition.

Detergents

Detergents, in addition to those described above as components (a) and (b), are known and may include neutral or overbased, Newtonian or non-Newtonian, basic salts of alkali, alkaline earth and transition metals with one or more hydrocarbyl sulphonic acid, carboxylic acid, phosphorus acid, mono- and/or di-thiophosphoric acid, alkyl phenol, sulphur coupled alkyl phenol compounds, salixarates, saligenins or mixtures thereof. Commonly used metals include sodium, potassium, calcium, magnesium lithium or mixtures thereof. Most commonly used metals include sodium, magnesium, calcium or mixtures thereof. Detergents and in particular overbased detergents and their preparation are disclosed in U.S. Pat. No. 3,629,109.

Antioxidant

Antioxidant compounds are known and include a diphenylamine, a hindered phenol, a molybdenum dithiocarbamate, a sulphurised olefin and mixtures thereof. Antioxidant compounds may be used alone or in combination.

The diphenylamine antioxidant may be represented by the formula:

(III)

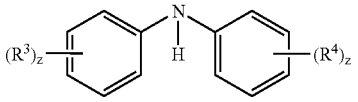

wherein $R^3$ and $R^4$ may be a hydrocarbyl groups, often arylalkyl or alkyl groups. The arylalkyl groups may contain 6 to 20 and in another aspect 6 to 10 carbons atoms. The alkyl groups may be linear or branched, especially linear; the alkyl groups may contain 1 to 24, in one aspect 2 to 18 and in another aspect 4 to 12 carbon atoms; and z is independently 0, 1, 2, or 3, provided that at least one aromatic ring contains a hydrocarbyl group. Especially useful alkylated diphenylamines include octyl diphenylamine, nonyl diphenylamine, bis-octyl diphenylamine and bis-nonyl diphenylamine.

The hindered phenol antioxidant often contains a secondary butyl and/or a tertiary butyl group as a sterically hindering group. The phenol group is often further substituted with a hydrocarbyl group and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol 2,6-di-tert-butylphenol. In one embodiment the hindered phenol antioxidant is an ester and may include, e.g., Irganox™ L-135 from Ciba. A more detailed description of suitable ester-containing hindered phenol antioxidant chemistry is found in U.S. Pat. No. 6,559,105.

Suitable examples of molybdenum dithiocarbamates which may be used as an antioxidant include commercial materials sold under the trade names such as Vanlube 822™ and Molyvan™ A from R. T. Vanderbilt Co., Ltd., and Adeka Sakura-Lube™ S-100, S-165 and S-600 from Asahi Denka Kogyo K. K and mixtures thereof.

Examples of suitable olefins that may be sulphurised to form an antioxidant include propylene, butylene, isobutylene, pentene, hexane, heptene, octane, nonene, decene, undecene, dodecene, undecyl, tridecene, tetradecene, pentadecene, hexadecene, heptadecene, octadecene, octadecenene, nonodecene, eicosene or mixtures thereof. In one embodiment, hexadecene, heptadecene, octadecene, octadecenene, nonodecene, eicosene or mixtures thereof and their dimers, trimers and tetramers are especially useful olefins. Alternatively, the olefin may be a Diels-Alder adduct of a diene such as 1,3-butadiene and an unsaturated ester such as butyl(meth)acrylate.

Another class of sulphurised olefin includes fatty acids and their esters. The fatty acids are often obtained from vegetable oil or animal oil; and typically contain 4 to 22 carbon atoms. Examples of suitable fatty acids and their esters include triglycerides, oleic acid, linoleic acid, palmitoleic acid or mixtures thereof. Often, the fatty acids are obtained from lard oil, tall oil, peanut oil, soybean oil, cottonseed oil, sunflower seed oil or mixtures thereof. In one embodiment fatty acids and/or ester are mixed with olefins. Sulphurised olefins may also provide extreme pressure performance and antiwear functionality to the composition.

Often an antioxidant is present on an oil free basis at 0 to 10, in one aspect 0.01 to 5, in another aspect 0.02 to 2 and in yet another aspect 0.03 to 1 weight percent of the composition.

Antiwear Agent

In certain embodiments of the invention the composition further contains (d) an antiwear agent such as a metal hydrocarbyl dithiophosphate often represented by the formula:

(VIII)

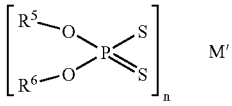

wherein $R^5$ and $R^6$ are independently hydrogen, hydrocarbyl groups or mixtures thereof, provided that at least one of $R^5$ and $R^6$ is a hydrocarbyl group, in one aspect alkyl or cycloalkyl with 2 to 30, in one aspect 3 to 10 and in yet another aspect 3 to 8 carbon atoms.

M' is a metal, and n is an integer equal to the available valence of M'. M' is mono- or di- or tri-valent, in one aspect divalent and in another aspect a divalent transition metal. In one embodiment M' is zinc. In one embodiment M' is calcium. In one embodiment M' is barium. Examples of a metal hydrocarbyl dithiophosphate include zinc dihydrocarbyl dithiophosphates (often referred to as ZDDP, ZDP or ZDTP). Examples of suitable zinc hydrocarbyl dithiophosphates compounds may include the reaction product(s) of heptylated or octylated or nonylated dithiophosphoric acids with ethylene diamine, morpholine or mixtures thereof.

In one embodiment, the antiwear agent is a salixarate detergent. These materials, which are also known as salts of linear (or cyclic) compounds containing phenolic and salicylic units, condensed with an aldehyde such as formaldehyde, are known from U.S. Patent Publication 2004/0186027 and copending U.S. application Ser. No. 10/751809 filed 5 Jan. 2004. These materials are useful both for their detergent properties and as antiwear agents. The corresponding unsalted material (salixarene) likewise also be used.

In an alternative embodiment the antiwear agent is ashless i.e. the antiwear agent is metal-free. Often the metal-free antiwear agent is an amine salt. The ashless antiwear agent often contains an atom including sulphur, phosphorus, boron or mixtures thereof.

Suitable hydrocarbyl amine salts of alkylphosphoric acid (which term is intended to include alkylthiophosphoric acid) may be represented by the following formulas:

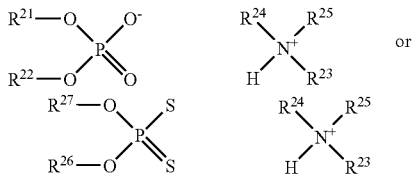

wherein $R^{21}$ and $R^{22}$ are independently hydrogen or hydrocarbyl groups such as alkyl groups; for the phosphorus acid ester, at least one of $R^{21}$ and $R^{22}$ will be hydrocarbyl. $R^{21}$ and $R^{22}$ may contain 4 to 30, or 8 to 25, or 10 to about 20, or 13 to 19 carbon atoms. $R^{23}$, $R^{24}$ and $R^{25}$ can be independently hydrogen or hydrocarbyl groups, such as alkyl branched or linear alkyl chains with 1 to 30, or 4 to 24, or 6 to 20, or 10 to 16 carbon atoms. These $R^{23}$, $R^{24}$ and $R^{25}$ groups can be branched or linear groups, and in certain embodiments at least one, or alternatively two of $R^{23}$, $R^{24}$ and $R^{25}$ are hydrogen. Examples of alkyl groups suitable for $R^{23}$, $R^{24}$ and $R^{25}$ include butyl, sec-butyl, isobutyl, tert-butyl, pentyl, n-hexyl, sec-hexyl, n-octyl, 2-ethylhexyl, decyl, undecyl, dodecyl, tridecyl, tetradecyl, pentadecyl, hexadecyl, heptadecyl, octadecyl, octadecenyl, nonodecyl, eicosyl groups and mixtures thereof. In one embodiment the hydrocarbyl amine salt of an alkylphosphoric acid ester can be the reaction product of a $C_{14}$ to $C_{18}$ alkylated phosphoric acid with Primene 81R™ (produced and sold by Rohm & Haas) which is a mixture of $C_{11}$ to $C_{14}$ tertiary alkyl primary amines.

The amine is often a primary amine, a secondary amine a tertiary amine or mixtures thereof. Often a primary amine and/or a secondary amine will contain at least one hydrocarbyl group with the number of carbon atoms present from 2 to 30, in one aspect 8 to in one aspect 26, in another aspect 10 to 20, and in yet another aspect 11 to 18.

Examples of primary amines useful in the present invention include ethylamine, propylamine, butylamine, 2-ethylhexylamine, octylamine and dodecylamine. Also suitable primary fatty amines which include n-octylamine, n-decylamine, n-dodecylamine, n-tetradecylamine, n-hexadecylamine, n-octadecylamine and oleyamine. Other useful fatty amines include commercially available fatty amines such as "Armeen®" amines (products available from Akzo Chemicals, Chicago, Ill.), such as Armeen C, Armeen O, Armeen OL, Armeen T, Armeen HT, Armeen S and Armeen SD, wherein the letter designation relates to the fatty group, such as coco, oleyl, tallow, or stearyl groups.

Examples of suitable secondary amines include dimethylamine, diethylamine, dipropylamine, dibutylamine, diamylamine, dihexylamine, diheptylamine, methylethylamine, ethylbutylamine and ethylamylamine. The secondary amines may be cyclic amines such as piperidine, piperazine and morpholine.

The amine may also be a tertiary-aliphatic primary amine. Often the aliphatic group is an alkyl group containing a number of carbon atoms from 2 to 30, in one aspect 6 to 26 and in another aspect 8 to 24. Often the tertiary alkyl primary amines are monoamines such as tert-butylamine, terthexylamine, 1-methyl-1-amino-cyclohexane, tert-octylamine, tert-decylamine, tertdodecylamine, tert-tetradecylamine, tert-hexadecylamine, tert-octadecylamine, terttetracosanylamine, and tert-octacosanylamine.

Mixtures of amines may also be used in the invention. Especially useful mixtures of amines are "Primene 81R" and "Primene JMT." Primene 81R and Primene JMT (both produced and sold by Rohm & Haas) are mixtures of $C_{11}$ to $C_{14}$ tertiary alkyl primary amines and $C_{18}$ to $C_{22}$ tertiary alkyl primary amines respectively.

The ashless antiwear agent may also include phosphoric acid esters or salts thereof; dialkyldithiophosphoric acid esters or salts thereof; phosphites; and phosphorus-containing carboxylic esters, ethers, and amides or mixtures thereof.

Other Ashless antiwear agent compounds include sulphur-containing ashless anti-wear additives are thiocarbamate-containing compounds, such as thiocarbamate esters, thiocarbamate amides, thiocarbamic ethers, alkylene-coupled thiocarbamates, and bis(S-alkyldithiocarbamyl) disulfides.

The dithiocarbamate-containing compounds may be prepared by reacting a dithiocarbamate acid or salt with an unsaturated compound. The dithiocarbamate containing compounds may also be prepared by simultaneously reacting an amine, carbon disulfide and an unsaturated compound. Generally, the reaction occurs at a temperature from 25° C. to 125° C. U.S. Pat. Nos. 4,758,362 and 4,997,969 describe dithiocarbamate compounds and methods of making them.

Useful fatty amines include commercially available fatty amines such as "Armeen" (RTM) amines (products available from Akzo Chemicals, Chicago, Ill.), such as Akzo's, Armeen C, Armeen O, Armeen OL, Armeen T, Armeen HT, Armeen S and Armeen SD, wherein the letter designation relates to the fatty group, such as coco, oleyl, tallow, or stearyl groups.

In an alternative embodiment of the invention, the ashless anti-wear agent may be a monoester of a polyol and an aliphatic carboxylic acid, often an acid containing 12 to 24 carbon atoms. Often the monoester of a polyol and an aliphatic carboxylic acid is in the form of a mixture with a sunflower oil or the like, which may be present in the friction modifier mixture from 5 to 95, in one aspect 10 to 90, in another aspect 20 to 85 and in yet another aspect 20 to 80 weight percent of said mixture. The aliphatic carboxylic acids (especially a monocarboxylic acid) which form the esters are those acids containing 12 to 24 carbon atoms and in one aspect 14 to 20 carbon atoms. Examples of carboxylic acids include dodecanoic acid, stearic acid, lauric acid, behenic acid, and oleic acid.

Polyols include diols, triols, and alcohols with higher numbers of alcoholic OH groups. Polyhydric alcohols include ethylene glycols, including di-, tri- and tetraethylene glycols; propylene glycols, including di-, tri- and tetrapropylene glycols; glycerol; butane diol; hexane diol; sorbitol; arabitol; mannitol; sucrose; fructose; glucose; cyclohexane diol; erythritol; and pentaerythritols, including di- and tripentaerythritol. Often the polyol is diethylene glycol, triethylene glycol, glycerol, sorbitol, pentaerythritol or dipentaerythritol.

The commercially available monoester known as "glycerol monooleate" is believed to include 60±5 percent by weight of the chemical species glycerol monooleate, along with 35±5 percent glycerol dioleate, and less than 5 percent trioleate and oleic acid. The amounts of the monoesters, described above, are calculated based on the actual, corrected, amount of polyol monoester present in any such mixture.

In one embodiment of the invention the antiwear agent is a borate ester. The borate ester may be prepared by the reaction of a boron compound and at least one compound selected from epoxy compounds, halohydrin compounds, epihalohydrin compounds, alcohols and mixtures thereof. Typically the alcohols include monohydric alcohols, dihydric alcohols, trihydric alcohols or higher alcohols.

Boron compounds suitable for preparing the borate ester include a boric acid (including metaboric acid, $HBO_2$, orthoboric acid, $H_3BO_3$, and a tetraboric acid, $H_2B_4O_7$), a boric oxide, a boron trioxide and an alkyl borate. The borate ester may also be prepared from boron halides. The borated ester further contains at least one hydrocarbyl group often containing about 8 to about 30 carbon atoms.

In another embodiment the antiwear agent can be a fatty amide. This can be an amide based on the condensation of a fatty amine as described above with a carboxylic acid, or the condensation of a fatty acid with ammonia or an amine. An illustrative fatty amide is oleamide.

Often the antiwear agent is present on an oil free basis from 0 to 10, in one aspect 0.01 to 5, in another aspect 0.02 to 2 and in yet another aspect 0.05 to 1 weight percent of the composition. The antiwear agent may be used alone or in combination.

Antiscuffing Agent

The lubricant may also contain an antiscuffing agent. Antiscuffing agent compounds are believed to decrease adhesive wear are often sulphur containing compounds. Typically the sulphur containing compounds include organic sulphides and polysulphides, such as dibenzyldisulphide, bis-(chlorobenzyl) disulphide, dibutyl tetrasulphide, di-tertiary butyl polysulphide, sulphurised methyl ester of oleic acid, sulphurised alkylphenol, sulphurised dipentene, sulphurised terpene, sulphurised Diels-Alder adducts, alkyl sulphenyl N'N-dialkyl dithiocarbamates, the reaction product of polyamines with polybasic acid esters, chlorobutyl esters of 2,3-dibromopropoxyisobutyric acid, acetoxymethyl esters of dialkyl dithiocarbamic acid and acyloxyalkyl ethers of xanthogenic acids and mixtures thereof.

Extreme Pressure Agents

Extreme Pressure (EP) agents that are soluble in the oil include sulphur- and chlorosulphur-containing EP agents, chlorinated hydrocarbon EP agents and phosphorus EP agents. Examples of such EP agents include chlorinated wax; organic sulphides and polysulphides such as dibenzyldisulphide, bis-(chlorobenzyl) disulphide, dibutyl tetrasulphide, sulphurised methyl ester of oleic acid, sulphurised alkylphenol, sulphurised dipentene, sulphurised terpene, and sulphurised Diels-Alder adducts; phosphosulphurised hydrocarbons such as the reaction product of phosphorus sulphide with turpentine or methyl oleate; phosphorus esters such as the dihydrocarbon and trihydrocarbon phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenol phosphite; metal thiocarbamates such as zinc dioctyldithiocarbamate and barium heptylphenol diacid; the zinc salts of a phosphorodithioic acid; amine salts of alkyl and dialkylphosphoric acids, including, for example, the amine salt of the reaction product of a dialkyldithiophosphoric acid with propylene oxide; and mixtures thereof.

Other performance additives such as corrosion inhibitors including octylamine octanoate, condensation products of dodecenyl succinic acid or anhydride and a fatty acid such as oleic acid with a polyamine; metal deactivators including derivatives of benzotriazoles, 1,2,4-triazoles, benzimidazoles, 2-alkyldithiobenzimidazoles or 2-alkyldithiobenzothiazoles; foam inhibitors including copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides; viscosity modifiers including styrene-butadiene rubbers, ethylene-propylene copolymers, hydrogenated styrene-isoprene polymers, hydrogenated radical isoprene polymers, poly (meth)acrylate acid esters, polyalkyl styrenes, polyolefins, polyalkylmethacrylates and esters of maleic anhydride-styrene copolymers; and friction modifiers including fatty acid derivatives such as amines, esters, epoxides, fatty imidazolines, condensation products of carboxylic acids and polyalkylenepolyamines and amine salts of alkylphosphoric acids may also be used in the composition of the invention.

Process

The invention also includes a process to prepare the composition of the present invention, comprising mixing:

(a) at least 3 weight percent of an overbased sulphonate detergent with a metal ratio of 12.5:1 to 40:1;

(b) at least 1.5 weight percent of a sulphur containing phenate detergent with a metal ratio of not more than 3; and (c) an oil of lubricating viscosity, wherein the sulphur containing phenate contains oligomers of hydrocarbyl phenol with at least 50 wt % of said oligomers in the form of the tetramer or higher oligomers.

If an additional component (d) such as an antiwear agent is present, such component can also be mixed with (a), (b), and (c), in any order.

The mixing conditions are typically 15° C. to 130° C., in one aspect 20° C. to 120° C. and in another aspect 25° C. to 110° C.; and for a period of time in the range 30 seconds to 48 hours, in one aspect 2 minutes to 24 hours, and in another aspect 5 minutes to 16 hours; and at pressures in the range 86.4 kPa to 266 kPa (650 mm Hg to 2000 mm Hg), in one aspect 91.8 kPa to 200 kPa (690 mm Hg to 1500 mm Hg), and in another aspect 95.1 kPa to 133 kPa (715 mm Hg to 1000 mm Hg).

The process optionally includes mixing other performance additives as described above. The optional performance additives may be added sequentially, separately or as a concentrate.

If the present invention is in the form of a concentrate (which may be combined with additional oil to form, in whole or in part, a finished lubricant), the ratio of each of the above-mentioned dispersant, as well as other components, to diluent oil is typically in the range of 80:20 to 10:90 by weight.

INDUSTRIAL APPLICATION

The compositions of the present invention are useful as detergents in an internal combustion engines, for example diesel fuelled engines, gasoline fuelled engines, natural gas fuelled engines or a mixed gasoline/alcohol fuelled engines.

In one embodiment of the invention provides a method for lubricating an internal combustion engine, comprising supplying thereto a lubricant comprising the composition as described herein. The invention is suitable for 2-stroke or 4-stroke marine diesel engines, especially 2-stroke marine engines. The use of the composition may impart one or more of improved cleanliness, reduced wear (especially cylinder wear) and reduced deposits.

The following examples provide an illustration of the invention. These examples are non exhaustive and are not intended to limit the scope of the invention.

EXAMPLES

Preparative Example 1

Formation of 500 TBN Sulphonate

A sample of a 500 TBN sulphonate detergent is prepared using a flange vessel with flange and clip, overhead stirrer with paddle and polytetrafluoroethylene (PTFE) stirrer gland, Dean Stark trap and double surface condenser, a mantle/thermocouple temperature controller system, the equipment from just above the mantle to just below the condenser being covered with glass wool. The vessel is charged with 35.1 parts by weight of C16-C24 alkylbenzene sulphonic acid and 31.8 parts by weight of mineral oil (SN 150) and heated to 30° C. The reactor is charged through a port with alcohols containing methanol and a mixture of iso-butanol/amyl alcohol present at 11.6 parts by weight. The weight ratio of methanol to the mixture of iso-butanol/amyl alcohol is 1.31. The reactor is charged with 14.9 parts by weight of calcium hydroxide and the mixture is heated to 54° C. where carbon dioxide is added to form a carbonated product. The carbonated product is further treated three more times with similar (or equal) portions of calcium hydroxide and carbon dioxide. Water is removed by stripping before repeating the addition of alcohol, calcium hydroxide and carbon dioxide 2 times. The product is stripped and filtered.

Reference Examples R1-R7

Reference Example 1 (R1)

An oil of lubricating viscosity is prepared by blending 80 wt % of Exxon™ 600 N oil with 11.9 mm2 s-1 (cSt) at 100° C. with 20 wt % of Exxon™ 150 BS oil with 31.7 mm2 s-1 (cSt) at 100° C. A commercially available conventional sulphur containing phenate detergent ("type 1") and a sulphonate detergent with a total base number of 500 are added to the oil of lubricating viscosity on an oil free basis at 4.6 wt % and 12.9 wt % respectively. The "sulphur containing phenate detergent ('type 1')" has a metal ratio of 8.6:1. The alkylphenol of the sulphur containing phenate oligomer has 22 wt % in the form of the dimer, 23 wt % in the form of the trimer and 46 wt % in the form of the tetramer or higher oligomers.

Reference Example 2 (R2)

The experimental procedure is identical to the process of Reference Example 1, except the phenate detergent is commercially available conventional sulphur containing phenate detergent ("type 2"). The "sulphur containing phenate detergent type 2" has a metal ratio of 7.7:1. The alkylphenol of the sulphur containing phenate oligomer has 22 wt % in the form of the dimer, 23 wt % in the form of the trimer and 46 wt % in the form of the tetramer or higher oligomers.

Reference Example 3 (R3)

The experimental procedure is identical to the process of Reference Example 1, except the phenate detergent is added on an oil free basis at 3.08 wt % and the sulphonate is added at 13.33 wt %.

Reference Example 4 (R4)

The experimental procedure is identical to the process of Reference Example 2, except the phenate detergent is added on an oil free basis at 3.08 wt % and the sulphonate is added at 13.33 wt %.

Reference Example 5 (R5)

The experimental procedure is identical to the process of Reference Example 1, except a detergent package of a sulphonate with a total base number of 400 is on an oil free basis added at 7.5 wt %; and a commercially available phenate detergent with a total base number of 250 is added on an oil free basis at 16 wt %. Furthermore the oil of lubricating viscosity contains on an oil free basis a polyisobutylene succinimide dispersant at 1.2 wt %.

Reference Example 6 (R6)

The experimental procedure is identical to the process of Reference Example 1, except sulphonate with a total base number of 400 is added on an oil free basis at 1.93 wt %; and a commercially available phenate detergent with a total base number of 250 is added on an oil free basis at 3.0 wt %.

Reference Example 7 (R7)

The experimental procedure is identical to the process of Reference Example 1, except sulphonate with a total base number of 400 is added on an oil free basis at 3.2 wt %; and a commercially available phenate detergent with a total base number of 250 is added on an oil free basis at 1.3 wt %.

Reference Examples 8-10

Reference Examples 8 to 10 are believed to be representative of commercially available materials containing an oil of lubricating viscosity and a detergent package (on a oil free basis) of 14.3 wt % of 250 TBN overbased phenate and 2.3 wt % of a 400 TBN sulphonate for Reference Example 8 (R8); 9.7 wt % of 250 TBN overbased phenate and 4.7 wt % of a 400 TBN sulphonate for Reference Example 9 (R9); and 4.8 wt % of 250 TBN overbased phenate and 7.7 wt % of a 400 TBN sulphonate for Reference Example 10 (R10).

Reference Example 11

Reference Example 11 is believed to be a commercially available material containing an oil of lubricating viscosity and a detergent package (on a oil free basis) of 1 wt % of 250 TBN overbased phenate and 9 wt % of a 400 TBN sulphonate; and an antiwear package containing on a oil free basis 0.5 wt % of a borated dispersant; 0.22 wt % of a zinc dithiophosphate; and 0.25 wt % of a sulphurised olefin.

Example 1 (Ex1)

The experimental procedure is identical to the process of Reference Example 1, except the phenate detergent is a commercially product available from The Lubrizol Corporation with a total base number of 150. The phenate detergent has a metal ratio of 1:1. The alkylphenol of the sulphur containing phenate is oligomerised with 13 wt % in the form of the dimer, 21 wt % in the form of the trimer and 60 wt % in the form of the tetramer or higher oligomers.

Example 2 (Ex2)

The experimental procedure is identical to the process of Reference Example 3, except the phenate detergent is the commercially available product of Ex1 with a total base number of 150.

Example 3 (Ex3)

The experimental procedure is identical to the process of Reference Example 1, except a detergent package of a sulphonate with a total base number of 500 is added on an oil free basis at 10.67 wt %; and the commercially available phenate detergent of Ex1, TBN 150, is added on an oil free basis at 5.56 wt %. Furthermore the oil of lubricating viscosity contains on an oil free basis a polyisobutylene succinimide dispersant in an amount of 1.2 wt %.

Example 4 (Ex4)

The experimental procedure is identical to the process of Reference Example 3, except the sulphonate with a total base number of 500 is added on an oil free basis at 9.52 wt % and the commercially available phenate detergent of Ex1, TBN 150, is added on an oil free basis at 14.93 wt %. Furthermore the oil of lubricating viscosity contains on an oil free basis a polyisobutylene succinimide dispersant at 0.6 wt %.

Example 5 (Ex5)

The experimental procedure is identical to the process of Reference Example 3, except the sulphonate with a total base number of 500 is added on an oil free basis at 12.66 wt % and the commercially available phenate detergent of Ex1, TBN 150, is added on an oil free basis at 4.62 wt %. Furthermore the oil of lubricating viscosity contains on an oil free basis a zinc oxidepolyisobutylene succinimide dispersant at 0.81 wt %.

Example 6 (Ex6)

The experimental procedure is identical to the process of Reference Example 5, except the sulphonate with a total base number of 500 is added on an oil free basis at 12.88 wt % and the commercially available phenate detergent of Ex1, TBN 150, is added on an oil free basis at 3.85 wt %.

Example 7 (Ex7)

The experimental procedure is identical to the process of Reference Example 5, except the sulphonate with a total base number of 500 is added on an oil free basis at 12.33 wt % and the commercially available phenate detergent of Ex1, TBN 150 is added on an oil free basis at 2.31 wt %.

Example 8 (Ex8)

The experimental procedure is identical to the process of Reference Example 5, except the sulphonate with a total base number of 500 is added on an oil free basis at 13.77 wt % and the commercially available phenate detergent of Ex1, TBN 150, is added on an oil free basis at 0.77 wt %.

Example 9 (Ex9)

Example 11 is the same as Reference Example 11, except the 250 TBN overbased phenate has been replaced with 3.4 wt % of the commercially available phenate detergent of Ex1, TBN 150.

Example 10 Ex10)

The experimental procedure is identical to the process of Reference Example 1, except a detergent package of a sulphonate with a total base number of 500 is added on an oil free basis at 8.8 wt %; and the commercially available phenate detergent of Ex1, TBN 150 is added on an oil free basis at 4 wt %. Furthermore the oil of lubricating viscosity contains on an oil free basis a nonborated polyisobutylene succinimide dispersant at 0.6 wt %.

Example 11 (Ex11)

The experimental procedure is identical to the process of Reference Example 1, except a detergent package of a sulphonate with a total base number of 500 is added on an oil free basis at 8.8 wt %; and the commercially-available phenate detergent, TBN 150, is added on an oil free basis at 4 wt %. Furthermore the oil of lubricating viscosity contains on an oil free basis a borated polyisobutylene succinimide dispersant at 0.5 wt %; a zinc dialkyldithiophosphate at 0.23 wt %; and a sulphurised olefin present at 0.25 wt %.

Example 12 (Ex12)

The experimental procedure is identical to the process of Reference Example 1, except a detergent package of a sulphonate with a total base number of 500 is added on an oil free basis at 6.4 wt %; and the commercially-available phenate detergent, TBN 150, is added on an oil free basis at 1.5 wt %; and an antiwear package containing a borated dispersant is added on an oil free basis at 0.5 wt % and glycerol monooleate present on an oil free basis at 0.5 wt %.

Example 13 (Ex13)

The experimental procedure is identical to the process of Reference Example 1, except a phosphoric acid ester amine salt is added on an oil free basis at 0.5 wt %.

Test 1: Pressurised Differential Scanning Calorimetry (PDSC)

Approximately 2.50 mg ±0.25 mg of sample is placed in a "TA DSC 2920™ Calorimeter," heated to 215° C. at 40° C. $min^{-1}$ and held at 690 kPa. The oxidation induction time for an oil of lubricating viscosity is determined by calculating the length of time a heated sample takes to oxidise. The results obtained by testing the lubricants of the indicated Examples are as shown:

| Example | PDSC Oxidation Induction Time (mins) |
|---|---|
| R1 | 35.1 |
| R2 | 29.5 |
| Ex1 | 50 |
| R3 | 27.1 |
| R4 | 16.1 |
| Ex2 | 43 |

Test 2: Panel Coker

Approximately 233 g of sample is placed in a 250 ml Panel Coker apparatus and heated to 325° C. The sample is splashed against a metal plate for 15 seconds and then baked for 45 seconds. The splashing and baking cycle is continued for approximately 3 hours. The sample is cooled to room temperature and the amount of deposits left on the metal plate is weighed. The results obtained by testing the lubricants of the indicated Examples are as shown:

| Example | Deposits (mg) |
|---|---|
| R1 | 140 |
| R2 | 297 |
| Ex1 | 110 |
| R3 | 264 |
| R4 | 353 |
| Ex2 | 217 |
| R5 | 88.3 |
| Ex3 | 24.9 |
| Ex4 | 15.4 |
| R6 | 88.9 |
| Ex5 | 19.2 |
| Ex6 | 53.4 |
| R7 | 334.4 |
| Ex7 | 112.5 |
| Ex8 | 183.2 |
| R8 | 63 |
| R9 | 102 |
| R10 | 167 |
| Ex9 | 68 |
| R11 | 177 |

Test 3: Cameron Plint of Examples 10 and 11

The Cameron Plint TE-77™ is a reciprocating wear tester. In this test a steel ball upper specimen is reciprocated against a steel flat lower specimen. The sample is initially treated with 3.5 wt % sulphuric acid. The Cameron Plint is then charged with 10 ml of the sample and heated to 50° C. and held for 20 minutes. The sample is then subject to a load of 25 N over two minutes while at the same time the reciprocation is started at 10 Hz over 15 mm stroke length. The sample is then heated to 350° C. at 2° C. per minute and held for 3 hours. At the end of the test the Onset of film failure is measured. The mid point of film failure is determined by the temperature at which the oil film as measured by the contact potential, first falls to half of its starting value. The results obtained by testing the lubricants of the indicated Examples are as shown:

| Example | Onset of Film Failure (° C.) | Mid-Point of Film Failure (° C.) |
|---|---|---|
| Ex10 | 210 | 245 |
| Ex11 | 280 | 315 |
| Ex12 | 270 | 295 |
| Ex13 | 295 | 300 |

The analysis of the experimental data obtained for the following combinations of reference examples and invention examples R1, R2 with Ex3; R1, R4 with Ex2; R5 with Ex3 and Ex4; R6 with Ex5 and Ex6; and R7 with Ex7 and Ex8; Ex10 with Ex11; Ex12 and Ex13 shows that overbased sulphonate detergents used in combination with the sulphur containing phenate detergents of the invention, have improved oil oxidation properties, reduced wear and less deposit formation than combinations of overbased sulphonate detergents and other commercially available sulphur containing phenate detergents.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements. As used herein, the expression "consisting essentially of" permits the inclusion of substances that do not materially affect the basic and novel characteristics of the composition under consideration.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

- hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);
- substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);
- hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, in one aspect no more than one, non-hydrocarbon substituent will be present for every ten carbon atoms in the hydrocarbyl group; typically, there will be no non-hydrocarbon substituents in the hydrocarbyl group.

What is claimed is:

1. A method for lubricating a marine diesel internal combustion engine, comprising supplying thereto a lubricant comprising:

(a). at least about 3 weight percent of an overbased sulphonate detergent with a metal ratio of about 12.5:1 to about 40:1;

(b). at least about 1.5 weight percent of a sulphur containing phenate detergent with a metal ratio of not more than about 3, wherein the sulphur containing phenate detergent has a TBN of about 50 to about 190; and (c). an oil of lubricating viscosity, (d) 0 wt % to 10 wt % of at least one optional performance additive selected from the group consisting of metal deactivators, dispersants, antioxidants, antiwear agents, corrosion inhibitors, antiscuffing agents, extreme pressure agents, foam inhibitors, demulsifiers, friction modifiers, viscosity modifiers, pour point depressants and mixtures thereof, wherein the sulphur containing phenate contains oligomers of hydrocarbyl phenol with at least about 50 wt % of said oligomers in the form of the tetramer or higher oligomers, wherein the total amount of (a) and (b) is 4.5 wt %, to 35 wt %, wherein the specific amounts of component (a) and component (b) are present such that component (a) delivers at least 60% of the TBN supplied by the detergents (a) and (b), and wherein the (TBN) of the composition is 30 or higher.

2. The method of claim 1, wherein the sulphonate detergent has a total base number of at least about 400.

3. The method of claim 1, wherein the sulphonate detergent has a total base number of at least about 450.

4. The method of claim 1, wherein the substrate of the sulphonate detergent is represented by the formula:

$$(R^1)_k\text{-A-SO}_3\text{M} \quad \text{(I)}$$

wherein, each $R^1$ is independently a hydrocarbyl group with a about 6 to about 40 carbon atoms; A is a cyclic or acyclic hydrocarbon group; M is a valence of metal ion, hydrogen, ammonium ion, or mixtures thereof; and k is 1 to about 5.

5. The method of claim 1, wherein the sulphonate detergent incorporates a metal ion selected from the group consisting of alkali metals, alkaline earth metals and mixtures thereof.

6. The method of claim 1, wherein the sulphur containing phenate detergent is represented by the formula:

(II)

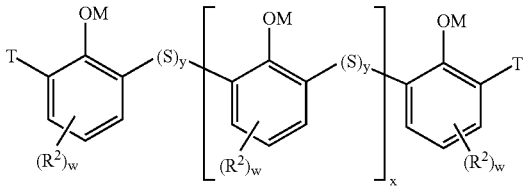

wherein the number of sulphur atoms y is 1 to about 8; T is hydrogen or an $(S)_y$ linkage terminating in hydrogen, an ion or a non-phenolic hydrocarbyl group; M is hydrogen, a valence of a metal ion, an ammonium ion or mixtures thereof, provided hydrogen is present on less than about 30% of the M entities; and $R^2$ is hydrogen or hydrocarbyl groups containing 4 to about 80 carbon atoms; x is 0 to about 10, provided that in at least about 50% of the molecules x is 2 or higher; w, is in the range from 0 to 3, provided that at least one aromatic ring contains an $R^2$ substituent and the total number of carbon atoms in the $R^2$ groups is at least 8.

7. The method of claim 1, wherein the sulphur containing phenate detergent contains less than about 20 wt % dimeric structures.

8. The method of claim 1, wherein the sulphur containing phenate detergent contains a substrate level excluding metal M and any carbonate of M in the range about 45 to about 95 wt % of the sulphur containing phenate detergent.

9. The method of claim 1, wherein the oil of lubricating viscosity comprises an API Group I, Group II, Group III, Group IV oil or mixtures thereof.

10. The method of claim 1 wherein the lubricant composition further comprises 0.1 wt % to 7 wt % of at least one optional performance additive selected from the group consisting of metal deactivators, detergents, dispersants, antioxidants, antiwear agents, corrosion inhibitors, antiscuffing agents, extreme pressure agents, foam inhibitors, demulsifiers, friction modifiers, viscosity modifiers, pour point depressants and mixtures thereof.

11. The method of claim 1 wherein the lubricant composition further comprises (d) an antiwear agent.

12. The method of claim 11, wherein the antiwear agent is an ashless antiwear agent containing at least one atom of sulphur, phosphorus, boron or mixtures thereof.

13. The method of claim 12, wherein the ashless antiwear agent is a sulphur-containing thiocarbamate.

14. The method of claim 11, wherein the ashless antiwear agent comprises a monoester of a polyol and an aliphatic carboxylic acid.

15. The method of claim 14, wherein the ashless antiwear agent comprises glycerol monooleate.

16. The method of claim 11 wherein the antiwear agent is selected from the group consisting of metal hydrocarbyl dithiophosphates, salixarates, fatty amides, amine salts of phosphoric acid esters, phosphoric acid salts, phosphites, phosphorus-containing carboxylic esters, phosphorus-containing carboxylic ethers, phosphorus-containing carboxylic amides, thiocarbamate esters, thiocarbamates amides, thiocarbamic ethers, alkylene-coupled thiocarbamates, bis(S-alkyldithocarbamyl)disulfides, monoesters of polyols and aliphatic carboxylic acids, borate esters, and mixtures thereof.

17. The method of claim 1 wherein the lubricant composition further comprises a borated dispersant.

18. The method of claim 1, wherein the internal combustion engine is a 2-stroke engine.

19. The method of claim 1, wherein the sulphur containing phenate detergent has a total base number from about 70 to about 175.

20. The method of claim 1, wherein the combined total amount of overbased sulphonate detergent and sulphur containing phenate detergent in the composition on an oil free basis is about 9 wt % to about 30 wt %.

* * * * *